US010310409B2

(12) United States Patent
Amano

(10) Patent No.: US 10,310,409 B2
(45) **Date of Patent: *Jun. 4, 2019**

(54) CARTRIDGE WITH A FIRST AND SECOND CHAMBER AND IMAGE FORMING APPARATUS CONTAINING THE SAME

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Takafumi Amano, Yokohama Kanagawa (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/972,338

(22) Filed: May 7, 2018

(65) Prior Publication Data

US 2018/0253029 A1 Sep. 6, 2018

Related U.S. Application Data

(63) Continuation of application No. 15/447,506, filed on Mar. 2, 2017, now Pat. No. 9,996,025.

(51) Int. Cl.
*G03G 15/08* (2006.01)

(52) U.S. Cl.
CPC ..... *G03G 15/0865* (2013.01); *G03G 15/0875* (2013.01); *G03G 15/0877* (2013.01)

(58) Field of Classification Search
CPC ..... G03G 15/0865; G03G 15/0877; G03G 15/0879; G03G 15/0881; G03G 15/0882
USPC ..... 399/106, 258, 259, 262
See application file for complete search history.

(56) References Cited

U.S. PATENT DOCUMENTS

| | | | |
|---|---|---|---|
| 8,023,858 | B2 | 9/2011 | Shinoda |
| 8,369,752 | B2 | 2/2013 | Furuta et al. |
| 8,532,538 | B2 | 9/2013 | Inoue |
| 9,280,093 | B2 | 3/2016 | Yokoyama et al. |
| 9,335,660 | B2 | 5/2016 | Yoshii |
| 9,996,025 | B1 * | 6/2018 | Amano ..... G03G 15/0865 |

OTHER PUBLICATIONS

Non-Final Office Action for U.S. Appl. No. 15/447,506 dated Oct. 26, 2017, 15 pages.

* cited by examiner

*Primary Examiner* — William J Royer
(74) *Attorney, Agent, or Firm* — Amin, Turocy & Watson LLP

(57) ABSTRACT

According to one embodiment, a cartridge is provided with a case and a transportation member. The case includes a first chamber, a second chamber, and a passage. The first chamber communicates with a discharging port and accommodates a developing agent. The second chamber is positioned distant from the discharging port compared to the first chamber and accommodates a toner. The passage allows the discharging port to communicate with the second chamber. The transportation member transports the toner, which is supplied to the passage from the second chamber, toward the discharging port.

18 Claims, 6 Drawing Sheets

CARTRIDGE WITH A FIRST AND SECOND CHAMBER AND IMAGE FORMING APPARATUS CONTAINING THE SAME

CROSS-REFERENCE TO RELATED APPLICATIONS

This application is a Continuation of application Ser. No. 15/447,506 filed on Mar. 2, 2017, the entire contents of which are incorporated herein by reference.

FIELD

Embodiments described herein relate generally to a cartridge, an image forming apparatus, and methods associated therewith.

BACKGROUND

When a developing agent is supplied to a developer of an image forming apparatus, a developing agent cartridge is provided in the image forming apparatus apart from a toner cartridge.

According to such a configuration, the image forming apparatus is required to have a relative large space therein to accommodate the various supplies.

DETAILED DESCRIPTION

In general, according to one embodiment, a cartridge includes a case and a transportation member. The case includes a first chamber, a second chamber, and a passage. The first chamber communicates with a discharging port and accommodates a developing agent. The second chamber is positioned distant from the discharging port compared to the first chamber and accommodates a toner. The passage allows the discharging port to communicate with the second chamber. The transportation member transports the toner, which is supplied from the second chamber to the passage, toward the discharging port.

Hereinafter, the cartridge and the image forming apparatus of the embodiment will be described with reference to drawings. Here, first, "front" and "rear" in the embodiment are defined. The "front" means a side closer than a center portion of an inside of an image forming apparatus 1 with respect to a user standing at a position where characters of a control panel 17 of the image forming apparatus 1 are shown normally. Meanwhile, the "rear" means a side distant from the center portion of the inside of the image forming apparatus 1 with respect to a user standing at a position where characters of the control panel 17 are shown normally.

Figure 1:
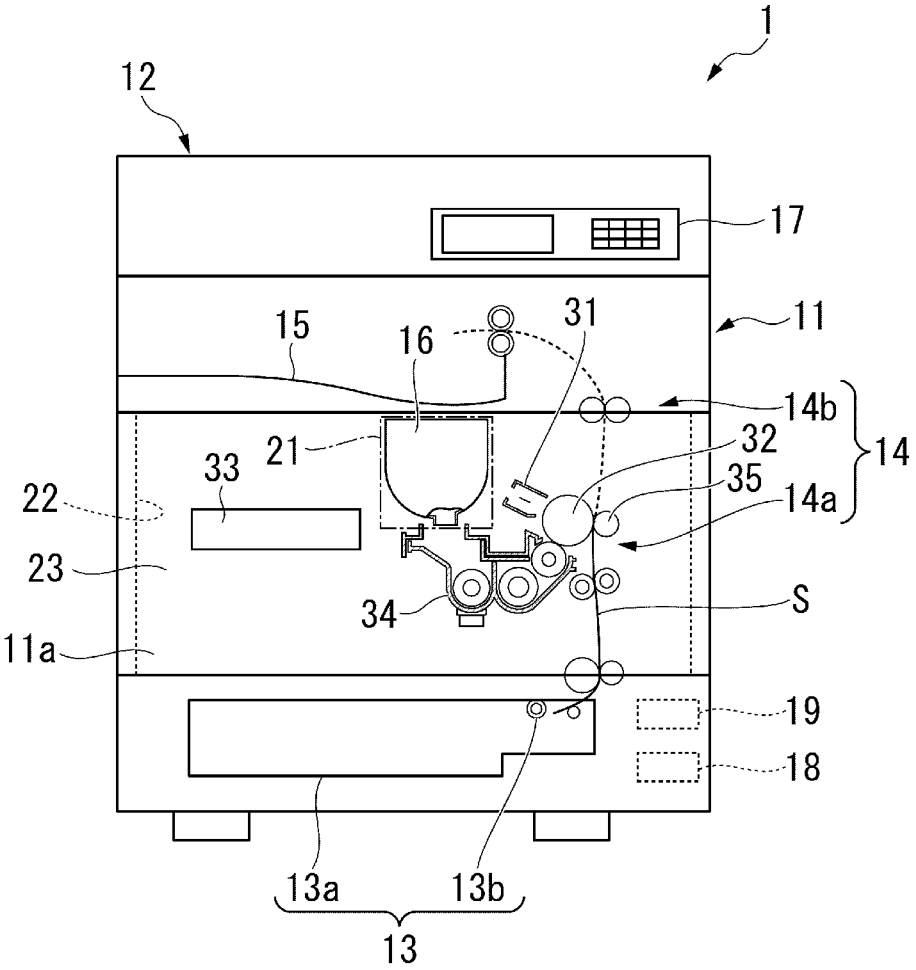
FIG. 1 is a view schematically illustrating a configuration example of an image forming apparatus of an embodiment.

FIG. 1 is a schematic view illustrating a configuration example of the image forming apparatus 1 of the embodiment. For example, the image forming apparatus 1 is a complex machine (MFP: Multi Function Peripheral). However, the image forming apparatus 1 is not limited to an example described above, and may be a copy machine, a printer, or the like.

Here, first, an entire configuration of the image forming apparatus 1 will be described.

As illustrated in FIG. 1, for example, the image forming apparatus 1 is provided with a housing 11, a scanner portion 12, a paper feeding portion 13, a printer portion 14, a paper discharging portion 15, a cartridge 16, the control panel 17, a storage portion 18, and a controller 19.

The housing 11 constitutes a contour of the image forming apparatus 1. The housing 11 accommodates the scanner portion 12, the paper feeding portion 13, the printer portion 14, the cartridge 16, the storage portion 18, and the controller 19.

The scanner portion 12 reads image information of an original document as digital data.

The paper feeding portion 13 includes, for example, a paper feeding cassette 13*a* (or paper feeding tray), and a pickup roller 13*b*. The paper feeding cassette 13*a* accommodates a sheet S. The pickup roller 13*b* transports the sheet S in the paper feeding cassette 13*a* toward the printer portion 14.

The printer portion 14 forms an image on the sheet S based on image data. In the embodiment, for convenience of description, the printer portion 14 of a direct transfer manner is described as an example. However, a configuration of the embodiment can be applied for the image forming apparatus including a printer portion of an intermediate transfer manner.

The paper discharging portion 15 discharges the sheet S on which an image is formed by the printer portion 14.

The cartridge 16 is a cartridge which is provided in the image forming apparatus 1, for example, when providing the image forming apparatus 1 or replacing a developing agent. The cartridge 16 of the embodiment sequentially supplies a developing agent and a toner to the printer portion 14.

The control panel 17 receives an input of various operation instructions.

The storage portion 18 stores various information items which are required for controlling the image forming apparatus 1.

The controller 19 controls the entire image forming apparatus 1. For example, the controller 19 controls operations of the scanner portion 12, the paper feeding portion 13, the printer portion 14, the cartridge 16, the control panel 17, and the storage portion 18.

Next, a configuration of each portion of the image forming apparatus 1 will be described.

First, the housing 11 will be described.

The housing 11 includes a cartridge accommodating portion 21, an opening portion 22, and a cover 23.

The cartridge accommodating portion 21 is in a space provided inside the housing 11. In the cartridge accommodating portion 21, the cartridge 16 is detachably accommodated. The cartridge accommodating portion 21 is an example of an "accommodating portion". In addition, the cartridge accommodating portion 21 is capable of accommodating a general toner cartridge (cartridge supplying only toner), instead of the cartridge 16 (cartridge sequentially supplying developing agent and toner) of the embodiment.

Figure 3:
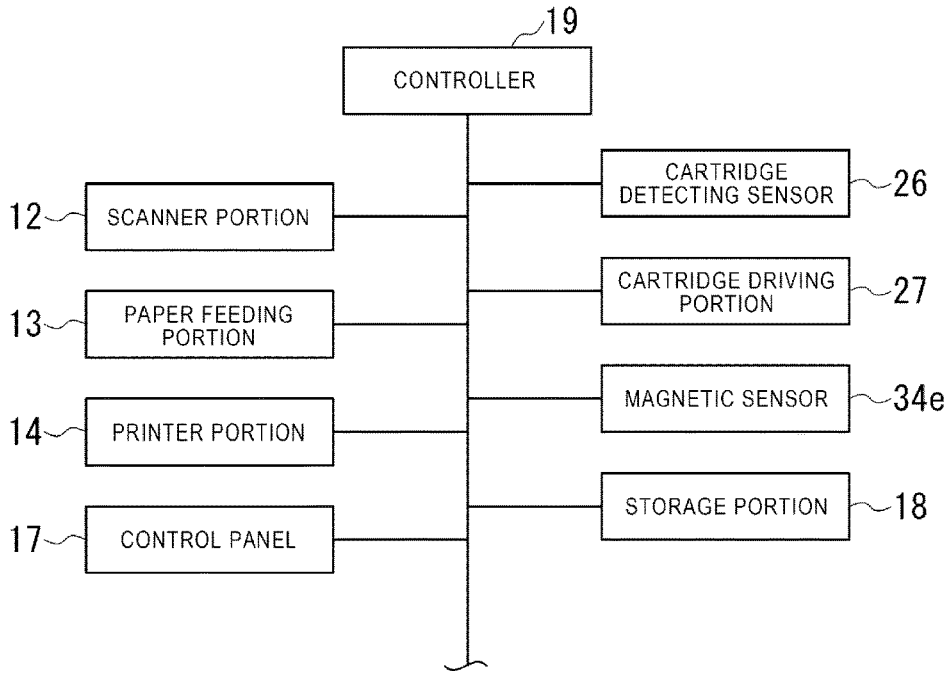
FIG. 3 is a block diagram illustrating a configuration example of a system.

In the cartridge accommodating portion 21, a cartridge detecting sensor 26 and a cartridge driving portion 27 are provided (refer to FIG. 3).

The cartridge detecting sensor 26 detects the cartridge 16 when the cartridge 16 is accommodated in the cartridge accommodating portion 21. For example, when the cartridge 16 is accommodated in the cartridge accommodating portion 21, the cartridge detecting sensor 26 detects the cartridge 16 by being directly or indirectly in contact with the cartridge 16. The cartridge detecting sensor 26 transmits a detected result of the cartridge detecting sensor 26 to the controller 19. The cartridge detecting sensor 26 is an example of a "sensor".

The cartridge driving portion 27 includes, for example, a coupling component (coupling component of main body side) 29 (refer to FIG. 5) connected to the cartridge 16, and a motor driving the coupling component 29. When the cartridge 16 is accommodated in the cartridge accommodating portion 21, the coupling component 29 is connected to the cartridge 16. The cartridge driving portion 27 drives first and second transportation members 43 and 44, to be described later, of the cartridge 16 through the coupling component 29. The cartridge driving portion 27 is a driving source provided on the outside of the cartridge 16. The cartridge driving portion 27 is an example of a "driving portion".

The opening portion 22 is provided on a part of a wall portion formed on a contour of the housing 11. For example, the opening portion 22 is provided on a front wall 11*a* of the housing 11. When the cover 23 to be described later is opened, the opening portion 22 exposes the cartridge accommodating portion 21 to the outside of the housing 11. A user of the image forming apparatus 1 and an operator of maintenance (hereinafter, refer to as a "user, or the like") can accommodate the cartridge 16 in the cartridge accommodating portion 21 through the opening portion 22, or pulls out the cartridge 16 from the cartridge accommodating portion 21. However, the opening portion 22 is not limited to providing in the front wall 11*a* of the housing 11, and may be provided on aside wall, or the like of the housing 11.

The cover 23 openably closes the opening portion 22. For example, when the opening portion 22 is provided on the front wall 11*a* of the housing 11, the cover 23 constitutes a part of the front wall 11*a* of the housing 11 by covering the opening portion 22.

Next, the printer portion 14 will be described.

The printer portion 14 includes a transferring portion 14*a* and a fixing portion 14*b*.

The transferring portion 14*a* includes an electrostatic charger 31, a photoconductive drum 32, a photosensitive unit 33, a developer 34, and a transferring roller 35. The electrostatic charger 31 charges a surface of the photoconductive drum 32 with a predetermined potential. The photoconductive drum 32 is an image carrier. In the photoconductive drum 32, a potential of a region irradiated with light is changed by applying light in a state in which a predetermined potential is given. The photosensitive unit 33 forms an electrostatic latent image on a surface of the photoconductive drum 32 by irradiating the photoconductive drum 32 with a laser beam. The developer 34 forms a toner image corresponding to an electrostatic latent image on a surface of the photoconductive drum 32 by supplying the toner to the surface of the photoconductive drum 32. The transferring roller 35 transfers the toner image on the photoconductive drum 32 to the sheet S by applying a predetermined potential to the sheet S.

The fixing portion 14*b* fixes the toner image to the sheet S by heating and pressurizing the sheet S to which the toner image is transferred.

Here, the developer 34 of the embodiment will be described in detail.

The developer 34 of the embodiment accommodates a two-component developing agent as the developing agent. The two-component developing agent is a mixture of a magnetic carrier and a toner. The magnetic carrier is an iron powder or a polymer ferrite particle. The magnetic carrier applies a triboelectric charge to the toner. The developer 34 supplies the toner carried to the inside of the developer 34 to a surface of the photoconductive drum 32.

Figure 2:
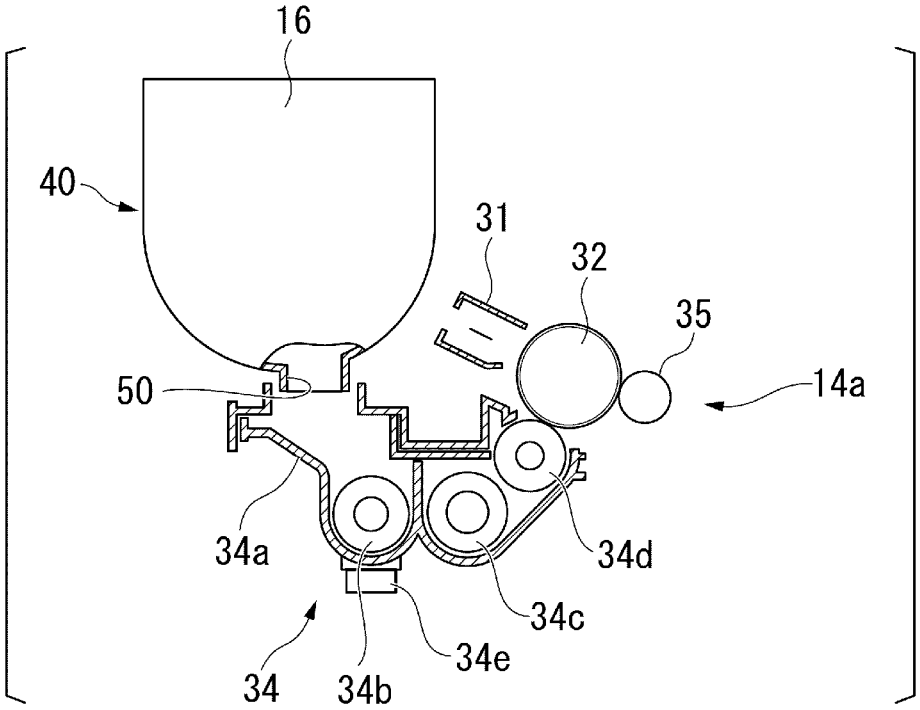
FIG. 2 is an enlarged sectional view illustrating a developer and peripheral components thereof.

FIG. 2 is an enlarged sectional view illustrating the developer 34 and peripheral components thereof.

As illustrated in FIG. 2, the developer 34 is provided with a developer case 34*a*, a first mixer 34*b*, a second mixer 34*c*, a developing roller 34*d*, and a magnetic sensor 34*e*. The developer case 34*a* is formed on a contour of the developer 34. The first mixer 34*b* and the second mixer 34*c* stir the developing agent and the toner which are supplied from the cartridge 16 into the developer case 34*a*. The developing roller 34*d* supplies the toner carried to the inside of the developer 34 to a surface of the photoconductive drum 32. The magnetic sensor 34*e* detects a magnetic state (for example, strength of magnetic) of the developing agent inside the developer case 34*a*. The magnetic sensor 34*e* is disposed, for example, under the first mixer 34*b*. The magnetic sensor 34*e* detects the magnetic state of the developing agent stirred by the first mixer 34*b*. The magnetic sensor 34*e* transmits a detected result of the magnetic sensor 34*e* to the controller 19.

FIG. 3 is a block diagram illustrating a configuration example of a system of the image forming apparatus 1.

As illustrated in FIG. 3, the controller 19 is electrically connected to the scanner portion 12, the paper feeding portion 13, the printer portion 14, the control panel 17, the storage portion 18, the cartridge detecting sensor 26, the cartridge driving portion 27, and the magnetic sensor 34*e* through an electrical connection passage such as a cable.

A part or the entirety of the controller 19, for example, is a software functional portion being realized by executing a program (software component) stored in the storage portion 18 with a processor (hardware processor). Moreover, a part or the entirety of the controller 19 may be realized by a hardware, for example, a large scale integration (LSI), an application specific integrated circuit (ASIC), or a field-programmable gate array (FPGA), or may be realized by a combination of a software functional portion and a hardware.

The storage portion 18 is formed of at least one of, for example, a hard disc drive (HDD), a flash memory, an electrically erasable programmable read only memory (EEPROM), a read only memory (ROM), or a random access memory (RAM).

Next, the cartridge 16 of the embodiment will be described.

The cartridge 16 of the embodiment is a cartridge which supplies both of the developing agent and the toner to the developer 34. For example, first, the cartridge 16 supplies the developing agent to the developer 34, and then, supplies the toner to the developer 34 with time difference.

Figure 4:
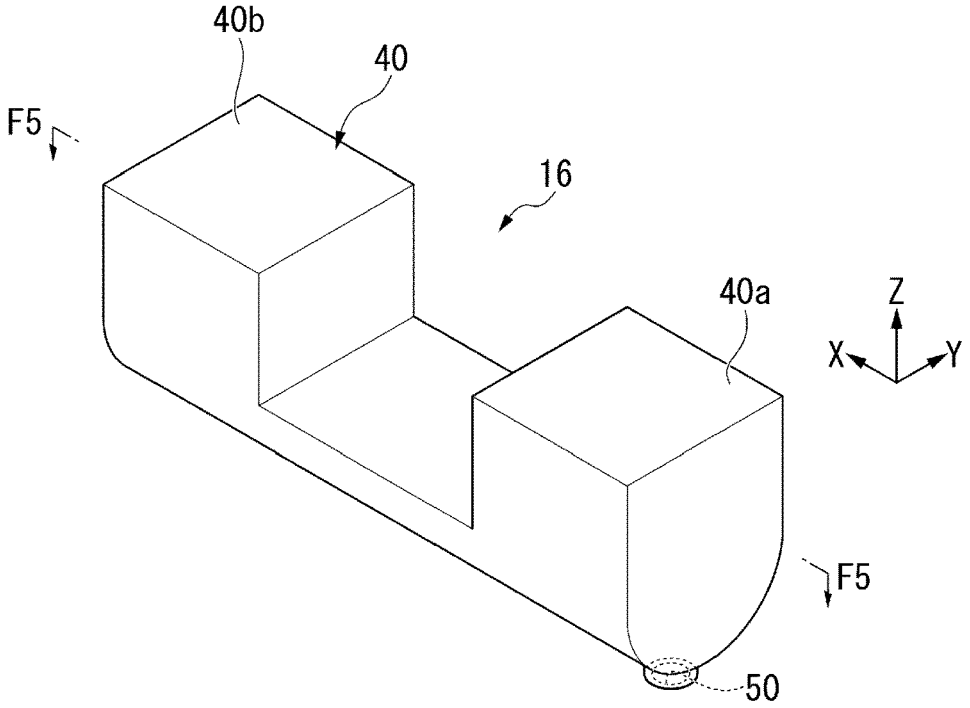
FIG. 4 is a perspective view illustrating a cartridge.

FIG. 4 is a perspective view illustrating the cartridge 16 of the embodiment. FIG. 4 illustrates the cartridge 16 in a posture in which the cartridge 16 is provided in the image forming apparatus 1. Hereinafter, "up" and "down" in description of the embodiment are based on the posture of FIG. 4.

Here, an "X direction", a "Y direction", and a "Z direction" are defined. The X direction and the Y direction are directions along a horizontal plane. The X direction is a longitudinal direction of the cartridge 16. The Y direction is a direction substantially orthogonal to the X direction. The Z direction is a substantially vertical direction. The Z direction is a direction substantially orthogonal to the X direction and the Y direction.

Figure 5:
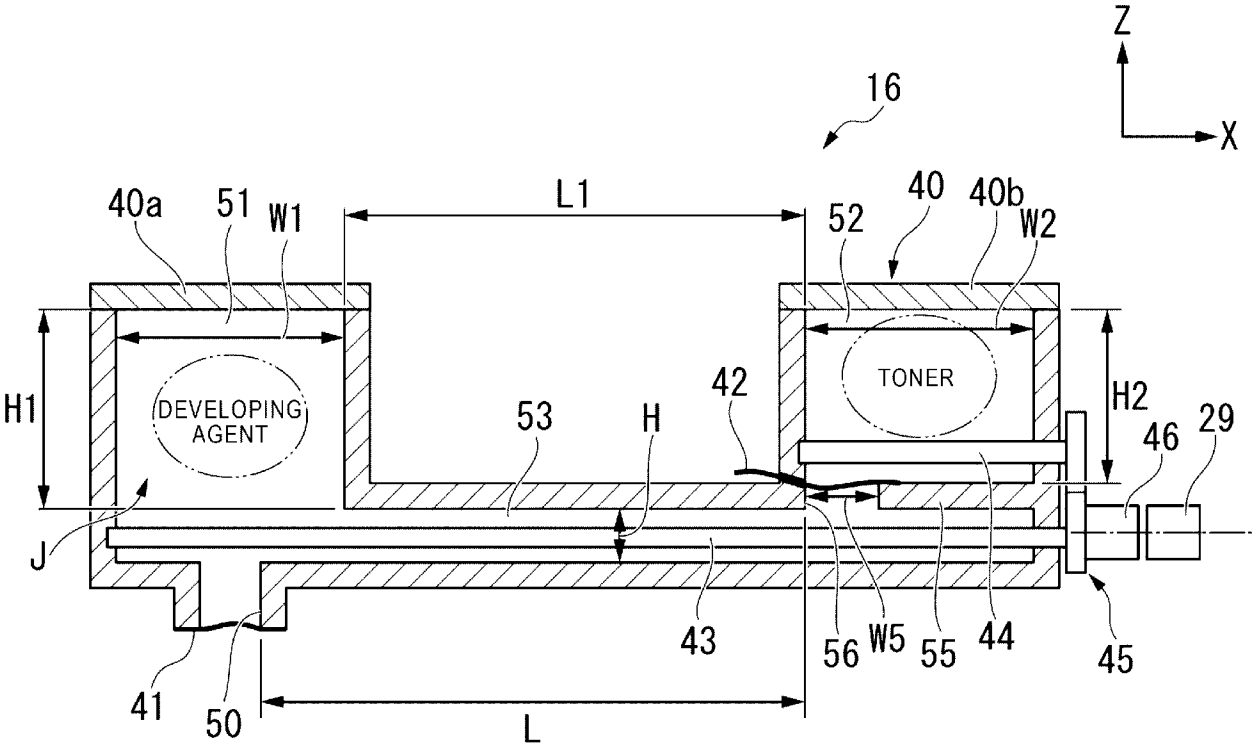
FIG. 5 is a sectional view taken along a line of F5-F5 of FIG. 4.

FIG. 5 is a sectional view taken along a line of F5-F5 of the cartridge 16 illustrated in FIG. 4. FIG. 5 illustrates the cartridge 16 in a state before being provided in the image forming apparatus 1.

As illustrated in FIG. 5, for example, the cartridge 16 is provided with a cartridge case 40, a first sealing member 41, a second sealing member 42, the first transportation member 43, the second transportation member 44, an engaging mechanism 45, and a coupling component (cartridge side coupling component) 46.

The cartridge case 40 (hereinafter, simply refer to as the case 40) is formed on a contour of the cartridge 16. The case 40 includes a first end portion 40*a* and a second end portion 40*b*. The first end portion 40*a* is one end portion of the case 40 in an X direction. The first end portion 40*a* is an end portion toward the opening portion 22 of the housing 11 in a state in which the cartridge 16 is accommodated in the cartridge accommodating portion 21. In other words, the first end portion 40*a* is positioned close to the opening portion 22 (that is, close to cover 23) of the housing 11, compared to the second end portion 40*b*. Meanwhile, the second end portion 40*b* is positioned on a side opposite to the first end portion 40*a* in the X direction.

The case 40 includes the discharging port (dropping port) 50 which supplies the developing agent and the toner to the developer 34. The discharging port 50 is provided under the case 40. The discharging port 50 is opened to the outside of the case 40. The discharging port 50 is positioned above of the developer 34 (for example, right above) in a state in which the cartridge 16 is accommodated in the cartridge accommodating portion 21 (refer to FIG. 2). For example, the developing agent and the toner inside the cartridge 16 are supplied to the developer 34 by being freely dropped from the discharging port 50 toward the developer 34 with gravity.

The discharging port 50 is provided on the first end portion 40*a* of the case 40. Therefore, the discharging port 50 is positioned closer to the opening portion 22 of the housing 11 than a second chamber 52 to be described later in a state in which the cartridge 16 is accommodated in the cartridge accommodating portion 21. Accordingly, a user, or the like who provides the cartridge 16 into the image forming apparatus 1 can check with eyes a position of the discharging port 50 with respect to the developer 34, a supplying state of the developing agent from the discharging port 50 to the developer 34, and the like, through the opening portion 22 of the housing 11.

The case 40 is provided with an inner space J inside the case 40 as a space accommodating the developing agent and the toner. The inner space J includes a first chamber 51, the second chamber 52, and a passage 53.

At least a part of the first chamber 51 is provided in the first end portion 40*a* of the case 40. The first chamber 51 is connected to the discharging port 50 through the passage 53. The first chamber 51 accommodates a developing agent which is a mixture of a magnetic carrier and a toner. For example, the first chamber 51 is provided above the discharging port 50 (for example, right above). Therefore, the developing agent inside the first chamber 51 is supplied from the discharging port 50 to the developer 34 by being freely dropped with gravity when the cartridge 16 is provided in the image forming apparatus 1.

At least a part of the second chamber 52 is provided in the second end portion 40*b* of the case 40. That is, the first chamber 51 and the second chamber 52 are positioned distant from each other at both end portions of the case 40 in the X direction. For example, a distance L1 between the first chamber 51 and the second chamber 52 in the X direction is longer than a width W1 of the first chamber 51 in the X direction (or a width W2 of the second chamber 52 in the X direction). The second chamber 52 is positioned distant from the discharging port 50 compared to the first chamber 51. The second chamber 52 accommodates a toner. That is, the second chamber 52 does not accommodate a magnetic carrier.

The passage 53 is provided along the X direction through the first end portion 40*a* and the second end portion 40*b* of the case 40. The passage 53 is positioned under the first chamber 51 in the first end portion 40*a* of the case 40, and is positioned above the discharging port 50. The passage 53 is positioned under the second chamber 52 in the second end portion 40*b* of the case 40. The passage 53 allows the second chamber 52 to communicate with the discharging port 50. The toner supplied from the second chamber 52 to the passage 53 is transported toward the discharging port 50 by the first transportation member 43 to be described later through the inside of the passage 53. The passage 53 is thinner than the first chamber 51 and the second chamber 52. For example, a width H (height) of the passage 53 in a Z direction is smaller than a width H1 of the first chamber 51 in the Z direction (or a width H2 of the second chamber 52 in the Z direction).

As illustrated in FIG. 5, the case 40 includes a partition wall 55 between the second chamber 52 and the passage 53. The partition wall 55 partitions the second chamber 52 and the passage 53. A communication port 56 is provided on the partition wall 55. The communication port 56 allows the second chamber 52 to communicate with the passage 53. A width W5 of the communication port 56 in the X direction is shorter than a width W2 of the second chamber 52 in the X direction. In addition, a distance L between the communication port 56 and the discharging port 50 in the X direction is longer than the width W1 of the first chamber 51 in the X direction (or the width W2 of the second chamber 52 in the X direction).

The first sealing member 41 is provided in the case 40, and detachably blocks the discharging port 50. In a state in which the first sealing member 41 is provided therein, the developing agent accommodated in the first chamber 51 is not leaked to the outside of the case 40 from the discharging port 50.

The second sealing member 42 is provided in the case 40, and detachably blocks the communication port 56. In a state in which the second sealing member 42 is provided therein, the toner accommodated in the second chamber 52 is not leaked to the passage 53. The second sealing member 42 is an example of a "partition member" which partitions between the second chamber 52 and the discharging port 50. The second sealing member 42 includes a protrusion portion which protrudes to the outside of the case 40. For example, a user, or the like can pull out the second sealing member 42 from the case 40 by pulling the protrusion portion. However, a position where the second sealing member 42 is provided is not limited to the example described above. For example, the second sealing member 42 may partition between the second chamber 52 and the discharging port 50 by being detachably provided at an arbitrary position between the second chamber 52 and the discharging port 50 (for example, arbitrary position inside passage 53).

Here, in the embodiment, a wall portion is absent between the first chamber 51 and the passage 53. However, the case 40 may include a wall portion such as the partition wall 55 and an opening portion such as the communication port 56 between the first chamber 51 and the passage 53. In this case, the opening portion may be detachably blocked by a sealing member such as the second sealing member 42.

The first transportation member 43 is provided on the passage 53 along the X direction. The first transportation member 43 extends an inside of the passage 53 through the first end portion 40*a* and the second end portion 40*b* of the case 40. For example, the first transportation member 43 is a transporting auger which transports the toner along the X direction. The first transportation member 43 transports the toner inside the passage 53 from the second end portion 40*b* toward the first end portion 40*a*. For example, the first transportation member 43 transports the toner, which is supplied to the passage 53 from the second chamber 52, toward the discharging port 50.

Figure 6:
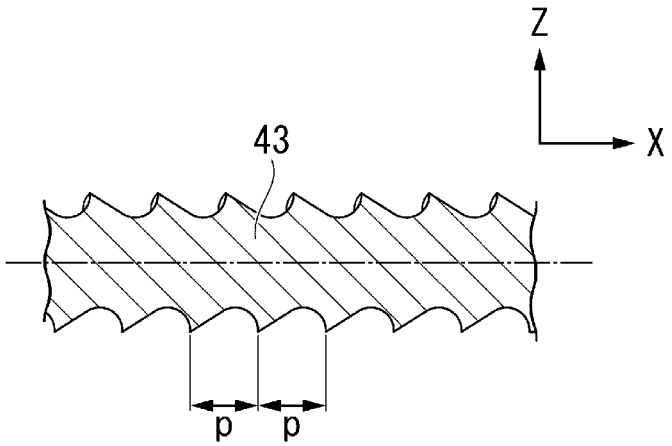
FIG. 6 is a sectional view illustrating a part of a first transportation member.

Here, FIG. 6 is a sectional view illustrating a part of the first transportation member 43.

As illustrated in FIG. 6, for example, the first transportation member 43 includes a screw. For example, a pitch p of the screw is 6 mm. That is, the first transportation member 43 moves the toner 6 mm toward the discharging port 50 by one time rotation.

When description continues back to FIG. 5 again, the second transportation member 44 is provided on the second chamber 52 along the X direction. For example, the second transportation member 44 is a transporting auger which transports the toner along the X direction. The second transportation member 44 transports the toner inside the second chamber 52 toward the communication port 56. For example, the second transportation member 44 includes the same screw as that of the first transportation member 43.

The engaging mechanism 45 is provided on the second end portion 40*b* of the case 40. The engaging mechanism 45 engages the first transportation member 43 with the second transportation member 44. For example, the engaging mechanism 45 includes a gear which is connected to the first transportation member 43, and a gear which is connected to the second transportation member 44. Accordingly, the engaging mechanism 45 engages a rotation operation of the first transportation member 43 and a rotation operation of the second transportation member 44. When such an engaging mechanism 45 is provided, the first transportation member 43 and the second transportation member 44 can be driven by one external driving source.

The coupling component 46 is connected to any one of the first transportation member 43, the second transportation member 44, and the engaging mechanism 45. The coupling component 46 is connected to the coupling component 29 of the cartridge driving portion 27. The coupling component 46 is driven and rotated by receiving power from the coupling component 29 of the cartridge driving portion 27. If the coupling component 46 is rotated, the first transportation member 43 and the second transportation member 44 are rotated through the engaging mechanism 45. Accordingly, the first transportation member 43 and the second transportation member 44 transport the toner in an inside of the cartridge 16.

Here, a driving unit of the image forming apparatus 1 is disposed at a rear part of the image forming apparatus 1 from a viewpoint of noise, or the like. In the embodiment, the coupling component 46 of the cartridge 16 is also provided closer to the second end portion 40*b* of the case 40 than the first end portion 40*a* of the case 40. Accordingly, the coupling component 46 of the cartridge 16 can be connected to the coupling component 29 of a main body side which is provided as a part of the driving unit of the image forming apparatus 1.

Next, action of the cartridge 16 and an operation example of the controller 19 of the image forming apparatus 1 which is related to the action of the cartridge 16 will be described.

The cartridge 16 is provided in the image forming apparatus 1 when the image forming apparatus 1 is provided or the developing agent is replaced. The cartridge 16 is accommodated in the cartridge accommodating portion 21 of the housing 11 in a state in which the first sealing member 41 and the second sealing member 42 are removed from the case 40. When the cartridge 16 is accommodated in the cartridge accommodating portion 21, the developing agent accommodated in the first chamber 51 is supplied from the discharging port 50 to the developer 34 by being freely dropped. In the embodiment, the second chamber 52 is positioned distant from the discharging port 50 compared to the first chamber 51. Therefore, the toner accommodated in the second chamber 52 is not moved to the passage 53 and does not reach the discharging port 50. As a result, the toner accommodated in the second chamber 52 is not supplied to the developer 34. Accordingly, the developing agent being supplied to the developer 34 can be maintained in a magnetic state the same as a state in which the agent is accommodated in the first chamber 51 (that is, a ratio of the magnetic carrier and the toner can be maintained).

Here, the developing agent inside the first chamber 51 of the cartridge 16 is adjusted in advance so that the ratio of the magnetic carrier and the toner falls within at an appropriate range. The controller 19 receives an initial value (for example, initial value of strength of magnetic) of the magnetic state of the developing agent detected by the magnetic sensor 34*e* from the magnetic sensor 34*e*, when the developing agent inside the developer 34 is replaced. Also, the controller 19 sets a threshold of the magnetic state for starting supply of the toner from the cartridge 16 to the developer 34, when the toner is reduced in accordance with a use of the image forming apparatus 1 based on the initial value of the magnetic state of the developing agent. The threshold is a value greater than an initial value of the magnetic state of the developing agent by a value (or ratio) set in advance. The controller 19 controls the cartridge driving portion 27 so that the toner is supplied from the cartridge 16 to the developer 34, when a value indicating the magnetic state of the developing agent periodically detected by the magnetic sensor 34*e* exceeds the threshold.

In addition, when the cartridge 16 is provided in the image forming apparatus 1, the controller 19 of the embodiment controls the cartridge driving portion 27 in order to start driving of the first and second transportation members 43 and 44 of the cartridge 16 after a preset time elapses from a timing when the cartridge 16 is detected by the cartridge detecting sensor 26.

Figure 7:
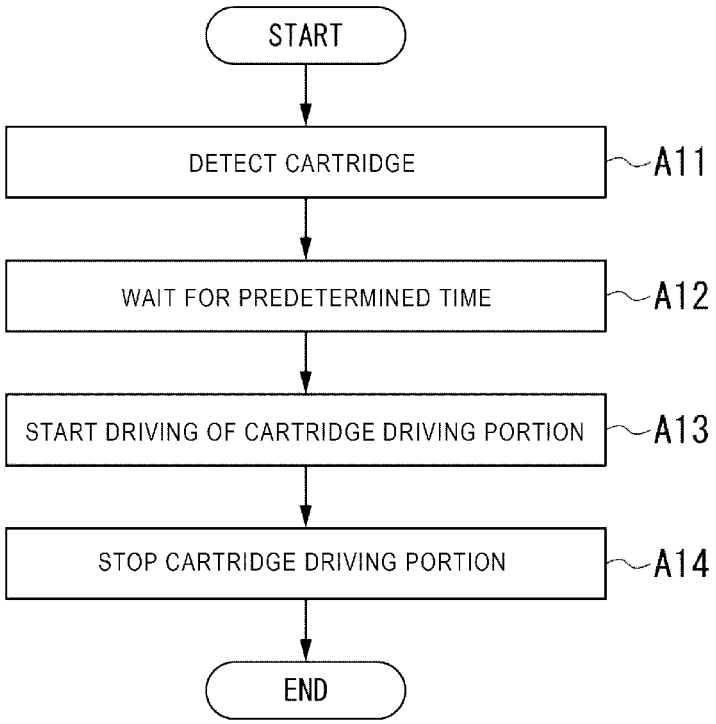
FIG. 7 is a flow chart illustrating an example of a flow of process of a controller.

FIG. 7 is a flow chart illustrating a flow of process.

As illustrated in FIG. 7, the cartridge detecting sensor 26 detects the cartridge 16 when the cartridge 16 is provided in the image forming apparatus 1 at the time of providing the image forming apparatus 1, replacing the developing agent, or the like (Act A11).

Next, regarding driving of the cartridge driving portion 27, the controller 19 waits without driving the cartridge driving portion 27, until a predetermined preset time elapses from a timing of receiving a signal indicating detection of the cartridge 16 by the cartridge detecting sensor 26 (Act A12). For example, the predetermined time is set as a sufficient time for supplying at least a certain amount of the developing agent, which is accommodated in the first chamber 51 of the cartridge 16, to the developer 34 by being freely dropped. For example, the controller 19 may receive information relating to the initial value of the magnetic state of the developing agent detected by the magnetic sensor 34*e* during the predetermined time (during waiting). Also, the controller 19 may set the threshold for starting a supply of the toner from the cartridge 16 to the developer 34 based on the initial value of the magnetic state of the developing agent detected by the magnetic sensor 34*e* during the predetermined time. The threshold set by the controller 19 is stored in the storage portion 18. Accordingly, the controller 19 is capable of acquiring the initial value of the magnetic state of the developing agent in a state in which the toner from the second chamber 52 is not mixed, and setting the threshold.

Moreover, a timing when the controller 19 acquires information relating to the initial value of the magnetic state of the developing agent and a timing when the controller 19 sets the threshold are not limited to an example described above, and a timing after the predetermined time elapses may be used. This is because the second chamber 52 and the discharging port 50 are distant from each other, and the toner does not reach the discharging port 50 immediately even when the predetermined time elapses and the cartridge driving portion 27 starts to be driven.

Also, the controller 19 starts to drive the cartridge driving portion 27 after the predetermined time elapses from a timing of receiving a signal indicating detection of the cartridge 16 by the cartridge detecting sensor 26 (Act A13). Accordingly, by rotating the first transportation member 43, the developing agent remained in the first chamber 51 and the passage 53 is supplied from the discharging port 50 to the developer 34.

Here, when a distance between the second chamber 52 and the discharging port 50 in the X direction is set to L, transportation distance per one second of the first transportation member 43 is set to M, and L/M is set to T (however, L and M are an arbitrary number), if the cartridge driving portion 27 is initially driven after the cartridge 16 is accommodated in the cartridge accommodating portion 21, the controller 19 stops the cartridge driving portion 27 at least once, before T seconds elapses from starting driving of the cartridge driving portion 27 (Act A14). In the embodiment, an example of the distance between the second chamber 52 and the discharging port 50 in the X direction is 200 mm or more. The rotation speed of the first transportation member 43 is 50 rpm. In addition, the transportation distance per one rotation of the first transportation member 43 is 6 mm. Therefore, the transportation distance M per one second of the first transportation member 43 is 5 mm. Therefore, T is 40 seconds. In the embodiment, the controller 19 stops the cartridge driving portion 27 after 30 seconds elapses from starting driving of the cartridge driving portion 27. Accordingly, during dropping of the developing agent, a possibility that the toner reaches the discharging port 50 can be further reduced. Here, "the distance between the second chamber 52 and the discharging port 50 in the X direction" in the description may be switched to "the distance between the communication port 56 and the discharging port 50 in the X direction".

Also, if the toner inside the developer 34 in accordance with a use of the image forming apparatus 1 is reduced, and a value of the magnetic state of the developing agent periodically detected by the magnetic sensor 34*e* excesses the threshold, the controller 19 controls the cartridge driving portion 27 so that the toner is supplied from the cartridge 16 to the developer 34. Accordingly, the toner supplied from the second chamber 52 to the passage 53 is transported by the first transportation member 43 and reaches the discharging port 50. Also, the toner is supplied from the discharging port 50 to the developer 34.

According to such a configuration described above, size reduction and cost reduction of the image forming apparatus 1 can be achieved. That is, in the embodiment, the cartridge 16 includes the case 40 and the first transportation member 43. The case 40 includes the first chamber 51 which communicates with the discharging port 50 and accommodates the developing agent, the second chamber 52 which accommodates the toner and is positioned distant from the discharging port 50 compared to the first chamber 51, and the passage 53 which allows the discharging port 50 to communicate with the second chamber 52. The first transportation member 43 transports the toner, which is supplied from the second chamber 52 to the passage 53, toward the discharging port 50. According to such a configuration, the developing agent and the toner can be sequentially supplied to the image forming apparatus 1 by one cartridge 16. Accordingly, the toner cartridge and the developing agent cartridge are not required to be separately provided in the image forming apparatus 1, and thus an inner space of the image forming apparatus 1 can be reduced. Accordingly, size reduction and cost reduction of the image forming apparatus 1 can be achieved. Further, according to the configuration described above, using a relative simple configuration, the cartridge 16 which sequentially supplies the developing agent and the toner to the image forming apparatus 1 can be realized. Accordingly, the cartridge 16 can also achieve low costs.

In the embodiment, the discharging port 50 of the cartridge 16 is disposed on a front part of the image forming apparatus 1 from a viewpoint of visibility. Meanwhile, the coupling component 46 of the cartridge 16 corresponds to a position where the driving unit of the image forming apparatus 1 is disposed and is disposed on a rear part of the image forming apparatus 1. Therefore, the cartridge 16 is formed in a relative elongated shape from the front part through to the rear part of the image forming apparatus 1. Meanwhile, an amount of the developing agent required for the developer 34 is smaller than a capacity of the cartridge 16 from the front part through to the rear part of the image forming apparatus 1. Here, in the embodiment, if the first chamber 51 and the second chamber 52 are provided using a size of the cartridge 16 from the front part through to the rear part of the image forming apparatus 1, and both the developing agent and the toner are accommodated.

Hitherto, an example of the cartridge 16 and the image forming apparatus 1 of the embodiment will be described, but the embodiment is not limited to an example described above. For example, an operation example of the controller 19 is not limited to the example described above. The controller 19 receives a signal indicating that the cartridge 16 is detected by the cartridge detecting sensor 26, and then the first and second transportation members 43 and 44 of the cartridge 16 may start to be driven immediately. Even in such a case, since the second chamber 52 of the case 40 is positioned distant from the discharging port 50, the developing agent is firstly supplied to the developer 34. In addition, when the controller 19 receives a signal indicating that the cartridge 16 is detected by the cartridge detecting sensor 26, and then the first and second transportation members 43 and 44 of the cartridge 16 starts to be driven immediately, the cartridge driving portion 27 may be stopped before T seconds elapses from starting driving of the cartridge driving portion 27. In such a case, even when the cartridge 16 is accommodated in the cartridge accommodating portion 21, and then the first and second transportation members 43 and 44 of the cartridge 16 starts to be driven immediately, discharge of the toner by the discharging port 50 can be suppressed.

In addition, some modification examples of the embodiment will be described later. Moreover, the other configurations in each modification example to be described later are the same as that of the embodiment. Therefore, the same numerals are given to configuration having the same or similar functions, and overlapping description thereof will be omitted.

First Modification Example

Figure 8:
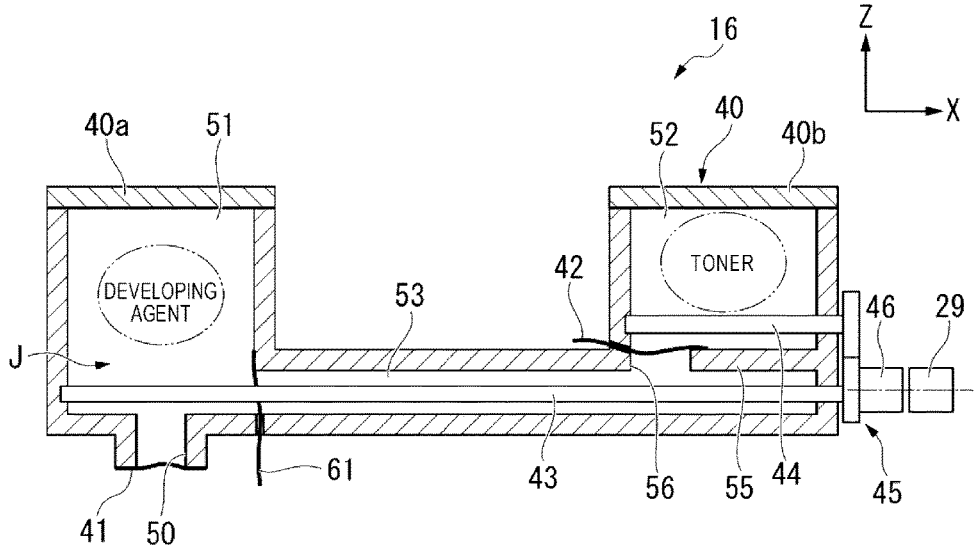
FIG. 8 is sectional view illustrating a cartridge of a first modification example.

FIG. 8 illustrates the cartridge 16 of a first modification example.

As illustrated in FIG. 8, the cartridge 16 of the modification example includes a third sealing member 61, in addition to the first sealing member 41 and the second sealing member 42. The third sealing member 61 is positioned at an arbitrary position inside the passage 53, and blocks the passage 53 between the first chamber 51 and the second chamber 52. Moreover, here, meaning of "blocks" described here also includes a case in which only a part region of an opening section of the passage 53 is blocked, in addition to a case the entire opening section of the passage 53 is blocked. For example, the third sealing member 61 is provided at a position closer to the first chamber 51 than the second chamber 52 in the passage 53. For example, the third sealing member 61 is disposed at a vicinity position of the first chamber 51. When the third sealing member 61 is provided, it is possible that the developing agent accommodated in the first chamber 51 is moved toward the second end portion 40*b* of the case 40 inside the passage 53.

Second Modification Example

Figure 9:
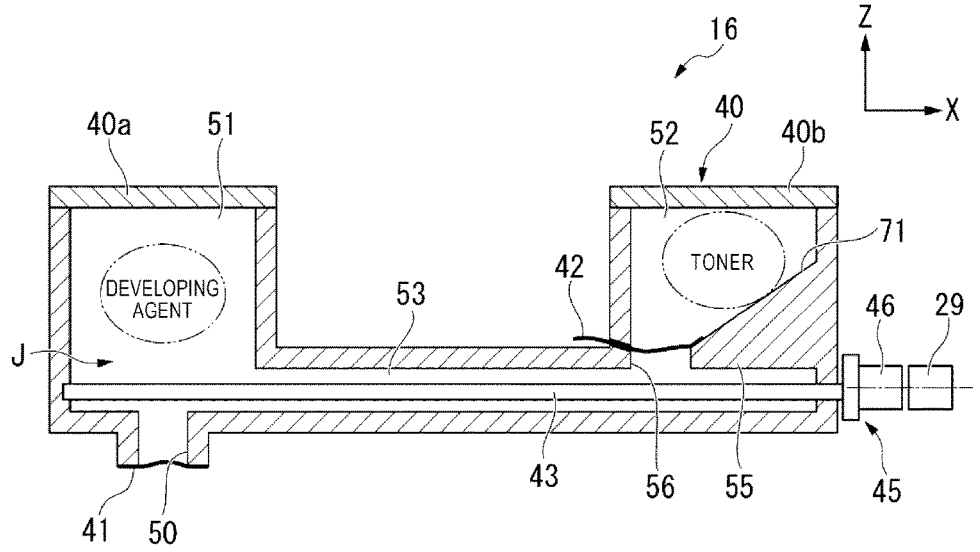
FIG. 9 is a sectional view illustrating a cartridge of a second modification example.

FIG. 9 illustrates the cartridge 16 of a second modification example.

As illustrated in FIG. 9, the cartridge 16 of the modification example includes an inclined bottom surface 71 provided in the second chamber 52 instead of the second transportation member 44. The inclined bottom surface 71 is inclined with respect to a vertical surface so as to become lower as the surface comes closer to the communication port 56. The toner accommodated in the second chamber 52 is guided to the communication port 56 by the inclined bottom surface 71. According to such a configuration, the second transportation member 44 can be omitted.

According to at least one of embodiments described above, since the second chamber which accommodates the toner is provided distant from the discharging port compared to the first chamber which accommodates the developing agent, the developing agent and the toner can be sequentially supplied by one cartridge. Accordingly, size reduction of the image forming apparatus can be achieved.

While certain embodiments have been described, these embodiments have been presented by way of example only, and are not intended to limit the scope of the inventions. Indeed, the novel embodiments described herein may be embodied in a variety of other forms, furthermore various omissions, substitutions and changes in the form of the embodiments described herein may be made without departing from the spirit of the inventions. The accompanying claims and there equivalents are intended to cover such forms or modifications as would fall within the scope and spirit of the invention.

What is claimed is:

1. A cartridge comprising:

a case comprising a first chamber in communication with a discharging port and accommodating a developing agent, a second chamber positioned distant from the discharging port compared to the first chamber and accommodating a toner, and a passage which allows the discharging port to communicate with the second chamber; and a first transportation member that transports the toner, from the second chamber to the passage, toward the discharging port, wherein the first chamber is positioned above the discharging port when the cartridge is provided in an image forming apparatus.

2. The cartridge according to claim 1, wherein the first chamber and the second chamber are separated from each other in a longitudinal direction of the cartridge.

3. The cartridge according to claim 1, further comprising:

a partition member that is detachably provided at a position between the second chamber and the discharging port, and the partition member forming a partition between the second chamber and the discharging port.

4. The cartridge according to claim 3, wherein the case comprises a communication port which allows the second chamber to communicate with the passage, and the partition member detachably blocks the communication port.

5. The cartridge according to claim 4, further comprising:

a second transportation member that transports the toner inside the second chamber toward the communication port.

6. An image forming apparatus comprising:

a cartridge comprising a case comprising a first chamber in communication with a discharging port and accommodating a developing agent, a second chamber which is positioned distant from the discharging port compared to the first chamber and accommodating a toner, a passage which allows the discharging port to communicate with the second chamber, and a transportation member transporting the toner from the second chamber to the passage toward the discharging port; and a developer supplying the developing agent and the toner from the cartridge, wherein the first chamber is positioned above the discharging port when the cartridge is provided in an image forming apparatus.

7. The apparatus according to claim 6, further comprising:

a housing comprising an accommodating portion which accommodates the cartridge;

a driving portion that drives the transportation member of the cartridge;

a sensor that detects the cartridge in the accommodating portion; and a controller that controls the driving portion to initiate driving the transportation member of the cartridge, after a preset time elapses from receiving a signal indicating that the cartridge is detected by the sensor.

8. The apparatus according to claim 6, further comprising:

a housing comprising an accommodating portion which accommodates the cartridge;

a driving portion that drives the transportation member of the cartridge; and a controller that stops the driving portion at least once before T seconds elapses from initiating the driving portion, when the driving portion is initially driven after the cartridge is accommodated in the accommodating portion, if a distance between the second chamber and the discharging port in a transportation direction of the transportation member is set to L, a transportation distance of the transportation member per one second is set to M, and L/M is set to T.

9. The apparatus according to claim 6, further comprising:

a housing comprising an accommodating portion which accommodates the cartridge, an opening portion which exposes the accommodating portion to the outside, and a cover which openably closes the opening portion, wherein the discharging port is positioned closer to the opening portion than the second chamber.

10. The apparatus according to claim 6, wherein the first chamber and the second chamber are separated from each other in a longitudinal direction of the cartridge.

11. The apparatus according to claim 6, further comprising:

a partition member that is detachably provided at a position between the second chamber and the discharging port, and the partition member forming a partition between the second chamber and the discharging port.

12. The apparatus according to claim 11, wherein the case comprises a communication port which allows the second chamber to communicate with the passage, and the partition member detachably blocks the communication port.

13. The apparatus according to claim 12, further comprising:

a second transportation member that transports the toner inside the second chamber toward the communication port.

14. An image forming method comprising:

supplying a developing agent from a first chamber in communication with a discharging port in a cartridge; and supplying simultaneously a toner from a second chamber through a passage allowing the discharging port to communicate with the second chamber in the cartridge, the second chamber positioned distant from the discharging port compared to the first chamber, wherein the first chamber is positioned above the discharging port when the cartridge is provided in an image forming apparatus.

15. The image forming method according to claim 14, further comprising:

detecting the cartridge; and initiating supplying the developing agent and toner after a preset time elapses from receiving a signal indicating that the cartridge is detected.

16. The image forming method according to claim 14, further comprising:

stopping supplying the developing agent and toner at least once before T seconds elapses from initiating the supplying, when the supplying is initiated after the cartridge is detected, if a distance between the second chamber and the discharging port in a transportation direction is set to L, a transportation distance per one second is set to M, and L/M is set to T.

17. The image forming method according to claim 14, further comprising:

exposing the cartridge to the outside by opening a cover, wherein the discharging port is positioned closer to the opening portion than the second chamber.

18. The image forming method according to claim 14, wherein the partition member detachably blocking the second chamber from the passage with a partition member detachably provided at a position between the second chamber and the discharging port.

* * * * *